US006152300A

United States Patent [19]

Perkins

[11] Patent Number: 6,152,300

[45] Date of Patent: Nov. 28, 2000

[54] TOOL STORAGE DEVICE FOR LINE INSTALLATION WORKERS

[76] Inventor: David Perkins, 283 Roman Rd., East Ham, London E6 3SQ, United Kingdom

[21] Appl. No.: 09/288,116

[22] Filed: Apr. 8, 1999

[51] Int. Cl.[7] ..... B65D 85/28

[52] U.S. Cl. ..... 206/373; 206/349; 383/9; 383/38; 182/129

[58] Field of Search ..... 206/349, 372, 206/373; 182/129; 383/38, 39, 22, 9

[56] References Cited

U.S. PATENT DOCUMENTS

| | | | |
|---|---|---|---|
| 1,094,009 | 4/1914 | Parkhurst | 206/373 |
| 1,171,896 | 2/1916 | Simpson | 206/373 |
| 1,172,044 | 2/1916 | Pope | 383/22 |
| 5,427,239 | 6/1995 | Hunt | 206/372 |
| 5,503,476 | 4/1996 | Hamdan | 383/9 |
| 5,638,915 | 6/1997 | Hardy | 182/129 |
| 5,813,530 | 9/1998 | Kornblatt | 206/373 |
| 5,971,101 | 10/1999 | Taggart | 182/129 |

*Primary Examiner*—Paul T. Sewell
*Assistant Examiner*—Jila M. Mohandesi

[57] ABSTRACT

A new tool storage device for line installation workers for draping and securing over a top of a telephone pole. The inventive device includes a piece of canvas material having a generally rectangular configuration. The canvas material has opposed long side edges and opposed short end edges. The canvas material has an aperture therethrough inwardly of the upper end edge. The aperture is dimensioned for receiving an upper end of a telephone pole therein. A plurality of tool and equipment storage compartments are disposed on the front surface of the canvas material disposed downwardly of the aperture.

2 Claims, 2 Drawing Sheets

TOOL STORAGE DEVICE FOR LINE INSTALLATION WORKERS

BACKGROUND OF THE INVENTION

1. Field of the Invention

The present invention relates to tool storage device for line installation workers and more particularly pertains to a new tool storage device for line installation workers for draping and securing over a top of a telephone pole.

2. Description of the Prior Art

The use of tool kits is known in the prior art. More specifically, tool kits heretofore devised and utilized are known to consist basically of familiar, expected and obvious structural configurations, notwithstanding the myriad of designs encompassed by the crowded prior art which have been developed for the fulfillment of countless objectives and requirements.

Known prior art tool kits include U.S. Pat. No. 5,002,401 to Blackman; U.S. Pat. No. 4,715,499 to Franklin; U.S. Pat. No. 5,427,239 to Hunt; U.S. Pat. No. 4,682,691 to Spiering; U.S. Pat. No. Des. 252,960 to Faust; and U.S. Pat. No. 5,299,683 to Poole.

While these devices fulfill their respective, particular objectives and requirements, the aforementioned patents do not disclose a new tool storage device for line installation workers. The inventive device includes a piece of canvas material having a generally rectangular configuration. The canvas material has opposed long side edges and opposed short end edges. The canvas material has an aperture therethrough inwardly of the upper end edge. The aperture is dimensioned for receiving an upper end of a telephone pole therein. A plurality of tool and equipment storage compartments are disposed on the front surface of the canvas material disposed downwardly of the aperture.

In these respects, the tool storage device for line installation workers according to the present invention substantially departs from the conventional concepts and designs of the prior art, and in so doing provides an apparatus primarily developed for the purpose of draping and securing over a top of a telephone pole.

SUMMARY OF THE INVENTION

In view of the foregoing disadvantages inherent in the known types of tool kits now present in the prior art, the present invention provides a new tool storage device for line installation workers construction wherein the same can be utilized for draping and securing over a top of a telephone pole.

The general purpose of the present invention, which will be described subsequently in greater detail, is to provide a new tool storage device for line installation workers apparatus and method which has many of the advantages of the tool kits mentioned heretofore and many novel features that result in a new tool storage device for line installation workers which is not anticipated, rendered obvious, suggested, or even implied by any of the prior art tool kits, either alone or in any combination thereof.

To attain this, the present invention generally comprises a piece of canvas material having a generally rectangular configuration. The canvas material has opposed long side edges and opposed short end edges. An upper end edge is curved. The canvas material has an aperture therethrough inwardly of the upper end edge. The aperture is dimensioned for receiving an upper end of a telephone pole therein. The canvas material has a press stud disposed on a front surface thereof above the aperture. A corresponding press stud is disposed on a back surface of the canvas material for coupling with the press stud on the front surface when the canvas material is in a rolled orientation. A shoulder strap is secured to the back surface of the canvas material. A plurality of tool and equipment storage compartments are disposed on the front surface of the canvas material disposed downwardly of the aperture. An elastic band is provided having a first end secured to one of the long side edges of the canvas material. The elastic band has a second end with a hook and loop patch disposed thereon for selectively mating with a hook and loop patch disposed on another long side edge of the canvas material after wrapping around the telephone pole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tool storage device for line installation workers apparatus and method which has many of the advantages of the tool kits mentioned heretofore and many novel features that result in a new tool storage device for line installation workers which is not anticipated, rendered obvious, suggested, or even implied by any of the prior art tool storage device for line installation workers, either alone or in any combination thereof.

It is another object of the present invention to provide a new tool storage device for line installation workers which may be easily and efficiently manufactured and marketed.

It is a further object of the present invention to provide a new tool storage device for line installation workers which is of a durable and reliable construction.

An even further object of the present invention is to provide a new tool storage device for line installation workers which is susceptible of a low cost of manufacture with regard to both materials and labor, and which accordingly is then susceptible of low prices of sale to the consuming public, thereby making such tool storage device for line installation workers economically available to the buying public.

Still yet another object of the present invention is to provide a new tool storage device for line installation workers which provides in the apparatuses and methods of the prior art some of the advantages thereof, while simultaneously overcoming some of the disadvantages normally associated therewith.

Still another object of the present invention is to provide a new tool storage device for line installation workers for draping and securing over a top of a telephone pole.

Yet another object of the present invention is to provide a new tool storage device for line installation workers which includes a piece of canvas material having a generally rectangular configuration. The canvas material has opposed long side edges and opposed short end edges. The canvas material has an aperture therethrough inwardly of the upper end edge. The aperture is dimensioned for receiving an upper end of a telephone pole therein. A plurality of tool and equipment storage compartments are disposed on the front surface of the canvas material disposed downwardly of the aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
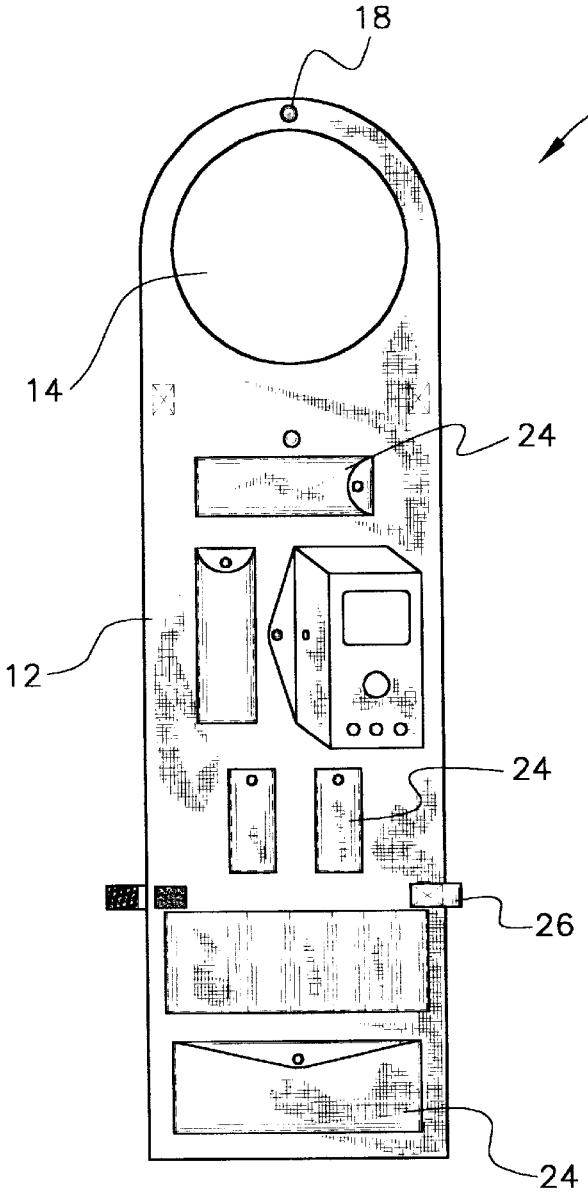
FIG. 1 is a front view of a new tool storage device for line installation workers according to the present invention.
Figure 2:
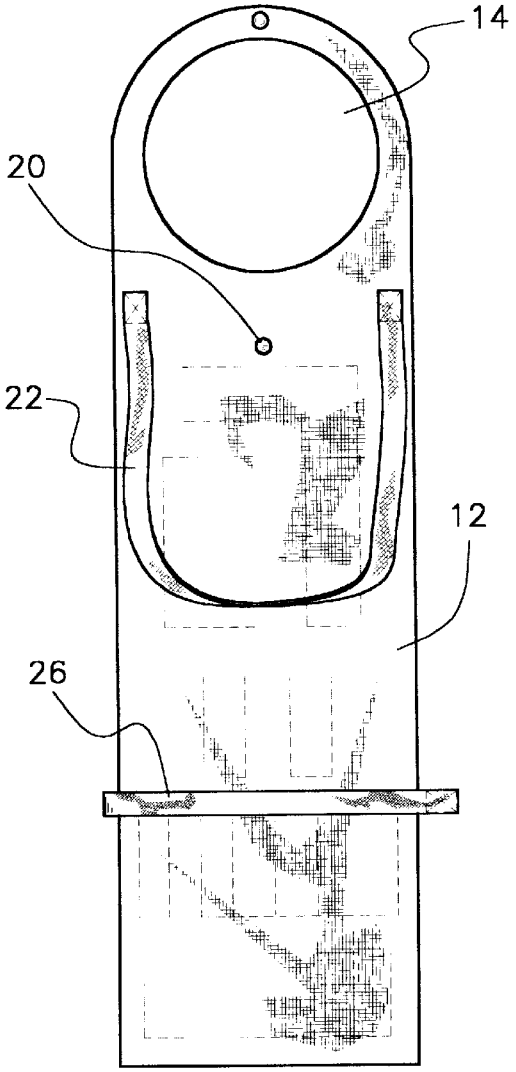
FIG. 2 is a back view of the present invention.
Figure 3:
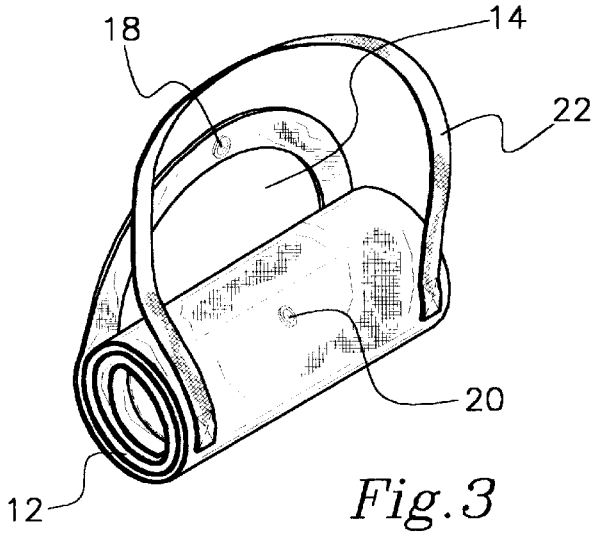
FIG. 3 is a perspective view of the present invention illustrated in a rolled orientation.
Figure 4:
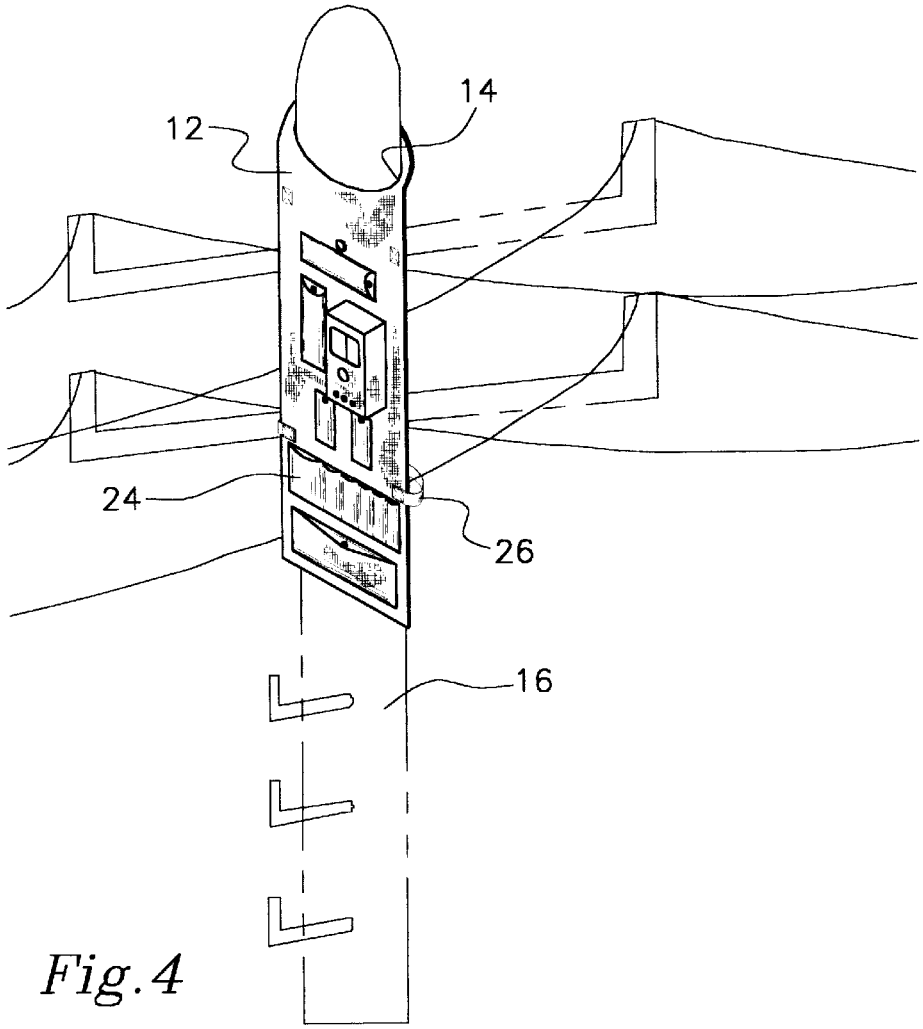
FIG. 4 is a perspective view of the present invention illustrated secured to a telephone pole.

With reference now to the drawings, and in particular to FIGS. 1 through 4 thereof, a new tool storage device for line installation workers embodying the principles and concepts of the present invention and generally designated by the reference numeral 10 will be described.

As best illustrated in FIGS. 1 through 4, the tool storage device for line installation workers 10 comprises a piece of canvas material 12 having a generally rectangular configuration. The canvas material 12 has opposed long side edges and opposed short end edges. An upper end edge is curved. The canvas material 12 has an aperture 14 therethrough inwardly of the upper end edge. The aperture 14 is dimensioned for receiving an upper end of a telephone pole 16 therein. The canvas material 12 has a press stud 18 disposed on a front surface thereof above the aperture 14. A corresponding press stud 20 is disposed on a back surface of the canvas material 12 for coupling with the press stud 18 on the front surface when the canvas material 12 is in a rolled orientation. Note FIG. 3.

A shoulder strap 22 is secured to the back surface of the canvas material 12. The shoulder strap 22 allows the user to carry the device 10 when the canvas material 12 is in the rolled orientation.

A plurality of tool and equipment storage compartments 24 are disposed on the front surface of the canvas material 12 disposed downwardly of the aperture 14. The storage compartments 24 will preferably be provided in numerous styles and sizes to accommodate various types of tools and equipment. When the canvas material 12 is in the rolled orientation, the storage compartments 24 will be disposed interiorly with respect to the canvas material 12 thereby precluding the loss of any of the tools or equipment.

An elastic band 26 is provided having a first end secured to one of the long side edges of the canvas material 12. The elastic band 26 has a second end with a hook and loop patch disposed thereon for selectively mating with a hook and loop patch disposed on another long side edge of the canvas material 12 after wrapping around the telephone pole 16. The elastic band 26 is positioned upwardly of the lower end of the canvas material 12 to prevent the unwanted movement of the canvas material 12 when positioned on the telephone pole 16.

In use, the worker would climb the pole 16 with the device 10 in the rolled orientation. Once he reached the top of the pole 16, he would secure his work belt and unroll the device 10. This is when he would place the aperture 14 over the top of the pole 16. The rounded upper edge of the canvas material would enhance the fit around the top of the pole 16. The canvas material 12 would unfold, and all the storage compartments 24 would be displayed in front of the worker.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new tool storage device for line installation workers for draping and securing over a top of a telephone pole comprising, in combination:

a piece of canvas material having a generally rectangular configuration, the canvas material having opposed long side edges and opposed short end edges, an upper end edge being curved, the canvas material having an aperture therethrough inwardly of the upper end edge, the aperture being dimensioned for receiving an upper end of a telephone pole therein, the canvas material having a press stud disposed on a front surface thereof above the aperture, a corresponding press stud disposed on a back surface of the canvas material for coupling with the press stud on the front surface when the canvas material is in a rolled orientation;

a shoulder strap secured to the back surface of the canvas material;

a plurality of tool and equipment storage compartments disposed on the front surface of the canvas material disposed downwardly of the aperture;

an elastic band having a first end secured to one of the long side edges of the canvas material, the elastic band having a second end with a hook and loop patch disposed thereon for selectively mating with a hook and loop patch disposed on another long side edge of the canvas material after wrapping around the telephone pole.

2. A tool storage device for line installation workers for draping and securing over a top of a telephone pole comprising:

a piece of material having a generally rectangular configuration, the material having opposed long side edges and opposed short end edges, an upper end edge being curved, the material having an aperture therethrough inwardly of the upper end edge, the aperture being dimensioned for receiving an upper end of a telephone pole therein, the material having a first fastener component disposed on a front surface thereof above the aperture, a corresponding second fastener component disposed on a back surface of the canvas material for coupling with the first fastener component on the front surface when the material is in a rolled orientation;

a shoulder strap secured to the back surface of the material;

a plurality of tool and equipment storage compartments disposed on the front surface of the material disposed downwardly of the aperture;

a band having a first end secured to one of the long side edges of the material, the band having a second end with a third fastener component disposed thereon for selectively mating with a fourth fastener component disposed on another long side edge of the material after wrapping around the telephone pole.

* * * * *